United States Patent [19]

Brandenfels

[11] 4,323,154

[45] Apr. 6, 1982

[54] FOLDED BOX WITH PUZZLE

[76] Inventor: Carl Brandenfels, Rte. 1, Box 1208, St. Helens, Oreg. 97051

[21] Appl. No.: 126,555

[22] Filed: Mar. 3, 1980

[51] Int. Cl.[3] ..... B65D 77/00; B65D 69/00

[52] U.S. Cl. ..... 206/216; 206/315 R; 229/16 D

[58] Field of Search ..... 206/315, 216; 229/38, 229/41 D, 16 D

[56] References Cited

U.S. PATENT DOCUMENTS

| | | | |
|---|---|---|---|
| 2,280,793 | 4/1942 | Carruth | 229/16 D |
| 2,995,238 | 8/1961 | Casselman | 206/315 |
| 3,066,843 | 12/1962 | Johnson | 206/216 X |
| 3,677,399 | 7/1972 | Tatar | 206/315 X |
| 3,704,892 | 12/1972 | Moravick et al. | 206/315 X |
| 3,767,043 | 10/1973 | Margolis | 206/315 |
| 4,177,917 | 12/1979 | Webinger | 229/16 D |

*Primary Examiner*—Steven M. Pollard
*Attorney, Agent, or Firm*—Chernoff & Vilhauer

[57] ABSTRACT

A novelty item comprising a prepared blank from which a box may be assembled and a card comprising a puzzle or another item in printed form and separable into a plurality of pieces which may be contained in the box once it has been erected and the pieces have been separated from one another. The prepared blank comprises a tubular passageway which may be used to retain the puzzle-containing card together with the prepared blank as a flat package during shipping and display for sale, permitting the novelty item to be mailed conveniently in flat form. The prepared blank has both top and bottom cover portions and additional tabs which fold across respective ends of the box, all attached as symmetrical portions of the prepared blank, giving the prepared blank an aesthetically pleasing symmetrical shape.

1 Claim, 7 Drawing Figures

FIG. 1
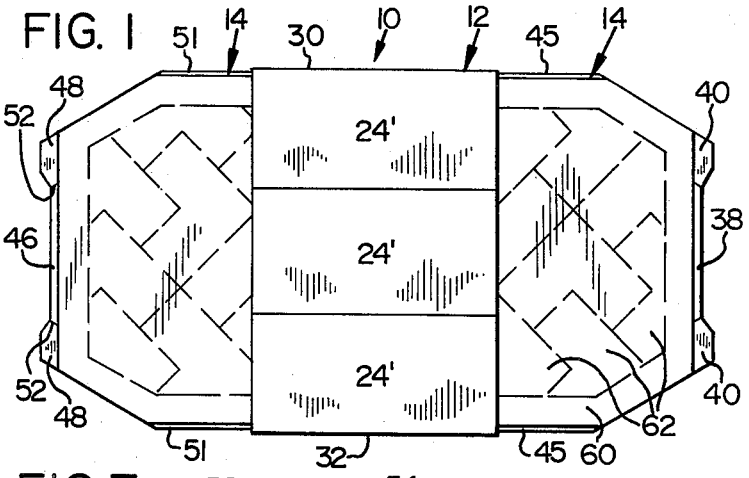
FIG. 6
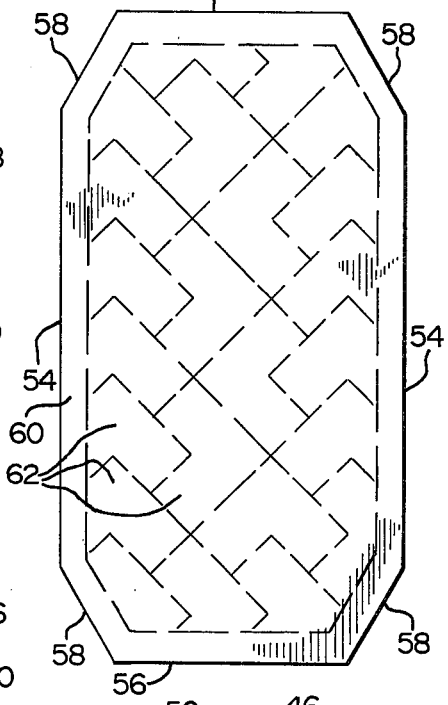
FIG. 7
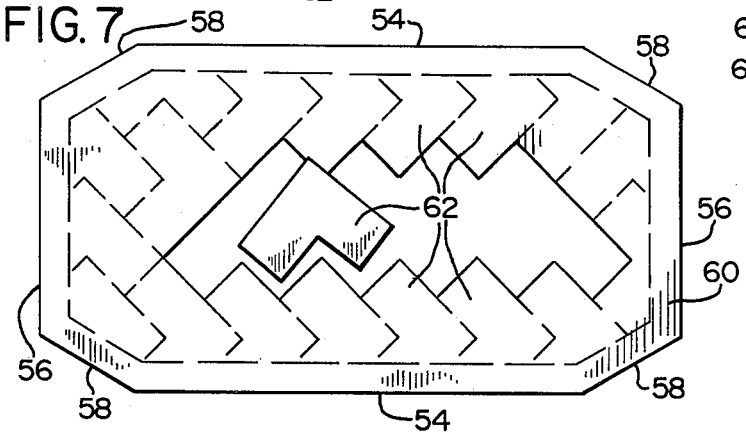
FIG. 5
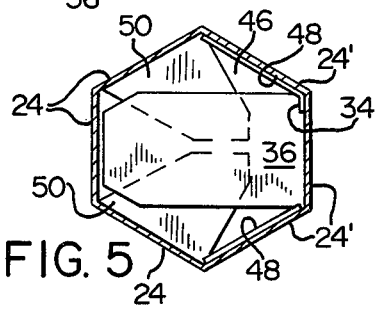
FIG. 2
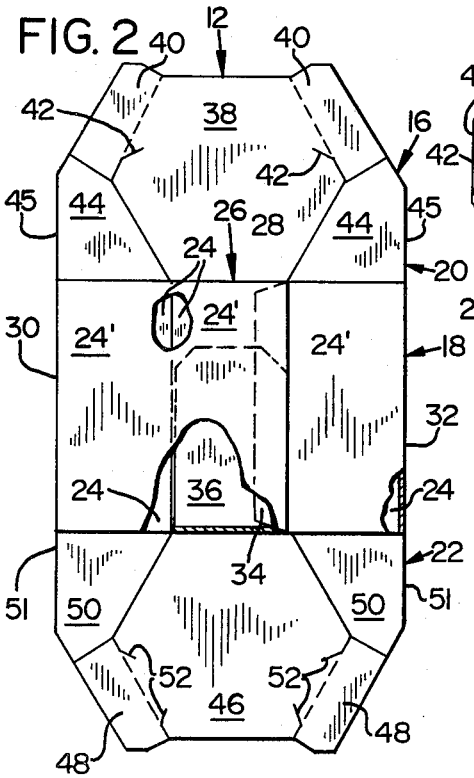
FIG. 3
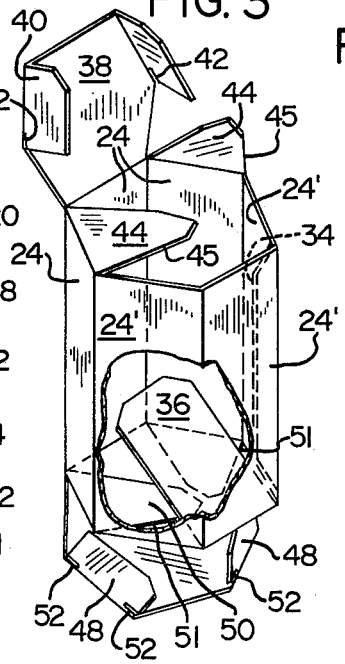
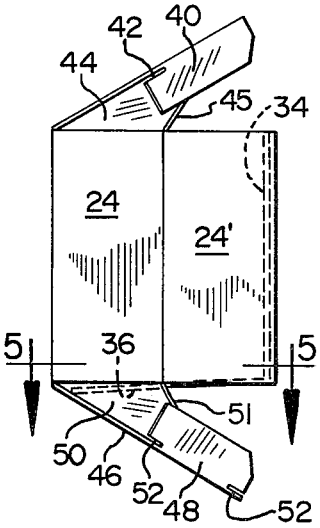
FIG. 4

FOLDED BOX WITH PUZZLE

BACKGROUND OF THE INVENTION

The present invention relates to a novelty item, and particularly to a folded box with an attached puzzle.

Novelty items in the form of a box which contain a whimsical insert of some sort are widely known in the prior art, and the last few years have become a popular gift item.

However, the prior art boxes of this type are sold in an erected form with the insert item contained within it. Accordingly, the boxes are quite bulky which makes them inconvenient and costly to ship and display. In addition if the purchaser wishes to mail a box to another as a gift, it must be placed in a suitable shipping carton which greatly increases the cost and inconvenience of mailing such an item.

While boxes in general are formed from knocked down flat box blanks, these blanks have heretofore been quite unattractive and would not be suitable aesthetically for resale as a gift item in this knocked down form. In addition, the prior art box blanks do not have means for attachment to the items which will be placed in them so that the box blank and the item can be shipped as an integral unit, thereby preventing their becoming separated from one another.

Accordingly, what is needed is a box blank which is asethetically pleasing in its knocked down form and which is capable of carrying an object which is to be inserted into the box in an integral fashion so that the knocked down box blank and the insert item together form a relative flat, symmetrical, asethetically pleasing unit.

SUMMARY OF THE INVENTION

The shortcomings and disadvantages of the previously known prepared blanks for boxes are overcome by the box blank and puzzle of the present invention, which provides a box blank having a surprisingly pleasing overall shape which is generally symmetrical. The box blank of the present invention may be erected into a box having a plurality of generally upright side panels and top and bottom covers which hold the side panels in proper relation to one another. In a preferred embodiment, the box blank of the invention comprises a sheet of material having a medial portion from which two end portions extend in opposite directions, forming a sheet having an oblong, generally octagonal shape. Flaps of the sheet material extending from the medial portion are folded toward one another and joined together in overlying relationship to the main portion of the sheet. The medial portion of the sheet and the attached flaps thus comprise all of the side panels of the box which may be erected from such a box blank. The end portions each include a cover having a pair of tongues of extend within the box, and a pair of tabs which are attached to respective ones of the side panels and fold toward the interior of the box.

The flaps overlying the medial portion of the sheet of the box blank of the present invention along with the medial portion form a flat tube and permit insertion of a card, such as a puzzle which has been die cut to nearly separate the puzzle pieces, within the box blank where it is securely held, presenting an attractive appearance of the combined box blank and puzzle. Preferably the card or sheet, comprising the puzzle or other item to be contained within the box when it is erected, is cut to a shape approximating that of the prepared box blank in flat form.

The appropriate shape of such a card permits the card to closely overlie the box blank, forming a neat, asthetically pleasing package, which can be shipped in large numbers in much less space than that required by an equal number of assembled boxes. The box blank and the card can, for instance, both have the same type of surface finish appearance, so that a nearly uniform appearance is presented by both the bottom of the sheet, corresponding to the outside of the box, and the face of the card held in the tubular box blank.

The flat form of such a package also permits mailing of the gift item in an envelope, without the need for special wrapping, and is thus much more convenient for use as a gift item than the same item in an assembled box.

In a preferred embodiment of the invention a box blank may be assembled into a box having the shape of a hexagonal prism. Such a box blank has end portions which include a hexagonal cover attached to the center one of three sides included in the sheet of material, and a pair of tabs attached respectively to the other two side panels included in the sheet. Tongues attached to two sides of the cover fit around the tabs so that the combination of the cover and the tabs making up the rest of the end portion extends across the full width of the three side panels of the box blank. The lateral extremities of the end portions are preferably extensions of the opposed edges of the medial portion defined by folds between the outer side panels of the sheet and the side panels included in the flaps attached to the medial portion of the sheet.

A card having the same general shape as the box blank is die cut into a jigsaw puzzle in which the pieces are left securely enough connected to one another so they will not be inadvertently separated during handling. Both the box blank and the puzzle may be imprinted with a selection of words, for instance pleasant and kind words, well wishing words, and greetings, which may be selectively underlined by the person making a gift of the novelty item, so that the recipient can assemble the puzzle and receive a message by reading the underlined words.

It is therefore a major objective of the present invention to provide a novelty item which can be conveniently mailed in a compact, flat form.

It is another objective of the present invention to provide a novelty item which can be shipped and displayed for sale in an attractive flat format, and may be assembled into a box containing a number of small pieces before being given as a present by the purchaser.

It is another objective of the present invention to provide a box blank having a pleasing symmetrical shape.

It is yet a further objective of the present invention to provide a box blank into which an accompanying novelty item in sheet form may be inserted while the box blank is in a flat form, to prevent separation of the novelty item sheet from the blank.

It is an important feature of the present invention that it provides a box blank which has a compact symmetrical shape, permitting attractive packaging.

It is another important feature of the present invention that it provides a box blank which, in its folded state, comprises a thin passageway into which a card of printed material can be inserted securely, yet which will allow a major portion of the card to be viewed by a prospective purchaser.

It is yet a further feature of the present invention that it provides a novelty gift item which includes a puzzle and a box to hold the puzzle pieces, with the box and the puzzle held together in an attractive compact box and the puzzle held together in an attractive, compact, flat format.

It is a primary advantage of the present invention that it provides a novelty item including a box blank which can be attractively packaged in a small amount of space.

It is another advantage of the present invention that it provides a novelty item which can be conveniently mailed in flat form, accompanied by a box blank which is more attractively shaped than those previously known.

The foregoing and other objectives and advantages of the present invention will be more readily understood upon consideration of the following detailed description of the invention taken in conjunction with the accompanying drawings.

BRIEF DESCRIPTION OF THE DRAWINGS

FIG. 1 is a plan view of an exemplary novelty item embodying the present invention, including a box blank and an accompanying puzzle in sheet form.

FIG. 2 is a partially cut away plan view of a box blank which is a part of the novelty item shown in FIG. 1. FIG. 3 is a partially cut away pictorial view of a box constructed from the box blank shown in FIG. 1.

FIG. 4 is a side elevational view of the box shown in FIG. 3.

FIG. 5 is a sectional view of the box shown in FIG. 4, taken along line 5—5.

FIG. 6 is a plan view of an exemplary puzzle in card form which is a part of the novelty item shown in FIG. 1.

FIG. 7 is a plan view of the puzzle shown in FIG. 6, in a partially disassembled condition.

DETAILED DESCRIPTION OF THE INVENTION

Referring now to the drawings, a novelty item 10 embodying the present invention is shown in FIG. 1, and comprises a box blank 12 and a card 14 which can be held within the box blank 12. Referring now also to FIG. 2, where the box blank 12 is shown alone, it may be seen that the box blank 12 comprises a sheet 16 of material such as cardboard and the like, and includes a medial portion 18, a first end portion 20, and a second end portion 22. The medial portion 18 comprises, in the illustrated embodiment, three foldably interconnected side panels 24, and a first flap 26 and a second flap 28 which are foldably attached respectively to the outer edges of the two outer side panels 24 to form the opposed edges 30 and 32 of the box blank. The first and second flaps 26 and 28 comprise three additional side panels 24' and are connected to one another, for instance by gluing along a connecting strip 34, so that all of the side panels are foldably attached to adjacent side panels, and the side panels 24' of the first and second flaps overlie the side panels 24 of the medial portion 18 of the sheet to form a thin passageway therebetween. An interior bottom flap 36 is foldably connected to the medial one of the side panels 24' and is arranged to fold so that it lies between the first flap 26 and the medial portion 18 of the sheet 16 when the box is erected.

The first end portion 20 comprises a top cover 38, which is foldably attached to the top edge of the medial panel 24, and to which a pair of tongues 40 are attached. Slits 42 separate a portion of each tongue 40 from the top cover 38. A pair of tabs 44 are foldably attached to the top edges of the other two side panels 24 of the sheet 16, and while located adjacent to the top cover 38 are separated from it so as to be free to move independently of the top cover. The lateral extremities 45 of the first end portion 20 are extensions of the edges 30 and 32 and form the edges of the tabs 44.

At the bottom end of the box blank, the second end portion 22 is similarly comprised of a bottom cover 46 which is foldably attached to the bottom edge of the medial side panel 24 and which has paired tongues 48. A pair of tabs 50 are foldably attached to the bottom edges of the other two side panels 24 of the sheet 16. A pair of slits 52 partially separate each tab 48 from the bottom cover 46, and lateral extremities 51 of the second end portion 22 are extensions of the edges 30 and 32 and form the edges of the tabs 50.

Referring now also to FIGS. 3–5, the box blank 12 is shown assembled into a box. It may be seen that the individual side panels 24 of the medial portion 18 of the sheet 16, and the side panels 24' of the first and second flaps 26 and 28 are folded relative to one another to form the sides of a hexagonal box. The covers 38 and 46 and the respective tabs 44 and 50 are also folded relative to the side panels 24 to which the covers are attached. The slits 42 and 52 permit portions of the respective tongues 40 and 48 to flex sufficiently to interlock with the respective tabs 44 and 50 and with the interior bottom flap 36, to prevent inadvertent opening of the box.

It may be seen in FIGS. 6 and 7 that the jigsaw puzzle is fashioned on a card 14 whose exterior shape is similar to the general shape of the sheet 16 of the box blank 12. Thus the card 14 has a first pair of parallel sides 54, a second pair of parallel sides 56 which are roughly perpendicular to the first parallel sides 54, and four oblique sides 58 which interconnect the parallel sides 54 and 56 to form an oblong octagonal shape. A border portion 60 circumscribes a plurality of jigsaw puzzle pieces 62 which are partially separated from one another by, for instance, die cutting, leaving the pieces weakly attached to the border portion 60 and to one another. The pieces 62 may then be easily separated from one another as illustrated in FIG. 7.

Since the box blank 12 and the puzzle card 14 are of similar shape, the puzzle card 14 may be inserted into the box blank 12 through the passageway which is formed between the medial portion 18 and the overlying first and second flaps 26 and 28. The novelty item 10 of the invention may then be packaged for display and sale in a flat form with the puzzle secured to the box blank as shown in FIG. 1, allowing it to be easily and conveniently sent through the mail. The box blank may then either be assembled into a box after purchase to contain the separated puzzle pieces 62 before the novelty item is presented as a gift, or it can be presented in its folded configuration.

In either case, the novelty item 10 of the invention may also be used to transmit a message to the recipient by the inclusion of words printed on the puzzle which can be read when the puzzle is assembled, or by underlining certain ones of a large number of words printed on the puzzle pieces 62 so that reading the underlined words conveys the desired message once the puzzle is assembled.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A novelty item comprising:

(a) a prepared blank for a box having a plurality of side panels, said prepared blank including:

(1) a flat sheet having a medial portion, said medial portion having a pair of opposed edges and defining a portion of the side panels of said box;

(2) a first end portion of said sheet, attached to said medial portion and defining a top member of said box;

(3) a second end portion of said sheet, attached to said medial portion and defining a bottom member of said box;

(4) flap means, defining the remainder of the side panels of said box, connected to said medial portion along one of said opposed edges, said flap being connected with the other of said opposed edges so as to overlie said portion of the side panels, said flap means and said medial portion together defining a passageway therebetween;

(b) a card extending through said passageway, said card having generally the same shape as said prepared blank and being no larger than said prepared blank;

(c) wherein said prepared blank and said card each have a generally octagonal shape, including a first pair of parallel sides, a second pair of parallel sides approximately perpendicular to said first pair of parallel sides, and four oblique sides interconnecting mutually perpendicular ones of said first and second pairs of parallel sides.

* * * * *